United States Patent [19]

Weisenbach et al.

[11] 3,933,083

[45] Jan. 20, 1976

[54] VARIABLE DISPLACEMENT CYLINDRICAL PUMP

[75] Inventors: Charles O. Weisenbach, Watertown; Donald R. Schneckenburger, Chaumont, both of N.Y.

[73] Assignee: General Signal Corporation, Rochester, N.Y.

[22] Filed: Oct. 21, 1974

[21] Appl. No.: 516,319

[52] U.S. Cl. ..... 92/12.2; 91/504

[51] Int. Cl.[2] ..... F01B 13/04

[58] Field of Search ..... 91/504, 505, 506, 499; 417/499; 92/12.2

[56] References Cited

UNITED STATES PATENTS

| | | | |
|---|---|---|---|
| 2,307,041 | 1/1943 | Hawley, Jr. et al. | 91/505 |
| 3,092,034 | 6/1963 | Bartholomaus | 91/499 |
| 3,266,434 | 8/1966 | McAlvay | 417/222 |
| 3,661,058 | 5/1972 | Peron | 91/505 |
| 3,834,281 | 9/1974 | Heyl | 91/506 |

*Primary Examiner*—William L. Freeh

*Attorney, Agent, or Firm*—Harold S. Wynn; Milton E. Kleinman

[57] ABSTRACT

A variable displacement cylindrical pump is provided having a sectional housing and a cam plate having trunnions and trunnion bearings. A first generally annular pump housing section is provided having oppositely disposed recesses formed in its inner periphery that have semi-circular portions at one end for axially receiving the cam plate trunnions and trunnion bearings. The trunnion bearings are secured in their recesses by the assembly of a second adjoining pump section housing and by biasing springs disposed between the trunnion bearings and the second housing section.

9 Claims, 7 Drawing Figures

FIG. 3
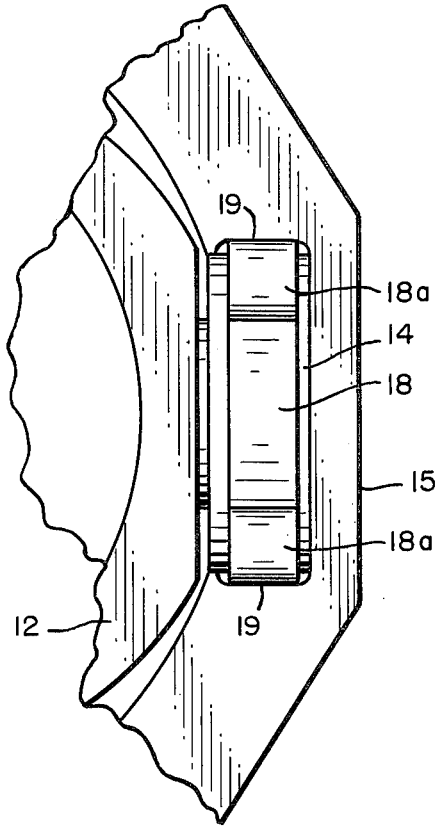
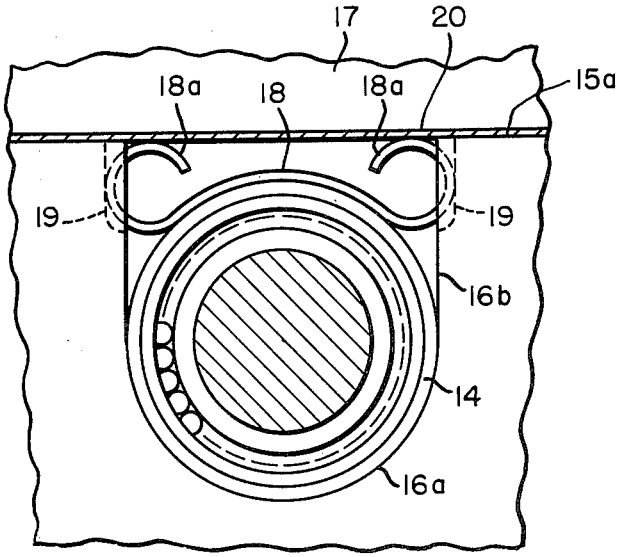
FIG. 2

VARIABLE DISPLACEMENT CYLINDRICAL PUMP

BACKGROUND OF INVENTION

This invention relates to variable displacement cylindrical pumps or motors, and while the invention is subject to a wide range of applications, it will be particularly described as applied to a variable delivery pump.

The present invention is an improvement over the system disclosed for journalling trunnions of a cam plate in the prior Budzich U.S. Pat. No. 3,093,081 granted June 11, 1963 and assigned to the same assignee as the present invention. In this patent, and in general practice, variable delivery is provided by a cam plate having trunnions supported along an axis normal to and intersecting an axis of rotation of the main shaft of the pump. Seats for trunnion bearings are provided in machined through openings at opposite sides of a pump casing, these openings being accurately machined to provide a proper fit for trunnion bearings or trunnion pins in order to prevent vibration of the cam plate. It is necessary that these openings be sealed with plugs and/or O-rings to prevent leakage of fluid. The original installation and maintenance of these seals and plugs, and the cost of machining the openings is expensive.

An object of the present invention is to provide a variable displacement cylindrical pump which substantially simplifies the described prior art arrangements.

Another object of the present invention is to provide a variable displacement cylindrical pump wherein no through openings are required in a pump casing for journalling a cam plate.

Other objects, purposes and characteristic features of the present invention will be in part obvious from the accompanying drawings and in part pointed out as the description progresses.

SUMMARY OF THE INVENTION

A variable displacement cylindrical pump is provided comprising a sectional housing and a cam plate having trunnions and trunnion bearings wherein oppositely disposed recesses are formed in an inner periphery of a first generally annular pump housing section, each of the recesses having semi-circular portions at one end for axially receiving the cam plate trunnions and trunnion bearings within the housing section. The trunnions and trunnion bearings are secured within the recesses by a second generally annular pump housing section adjoining the first housing section. The trunnion bearings are spring biased against the semi-circular portions of the recesses to prevent vibration of the cam plate.

For a better understanding of the present invention, together with other and further objects thereof, reference is had to the following description, taken in connection with the accompanying drawings, while its scope will be pointed out in the appending claims.

IN THE DRAWINGS

FIG. 2 is an enlarged view taken along the line 2—2 of FIG. 1;

FIG. 3 is an enlarged view taken along the line 3—3 of FIG. 1;

Figure 1:
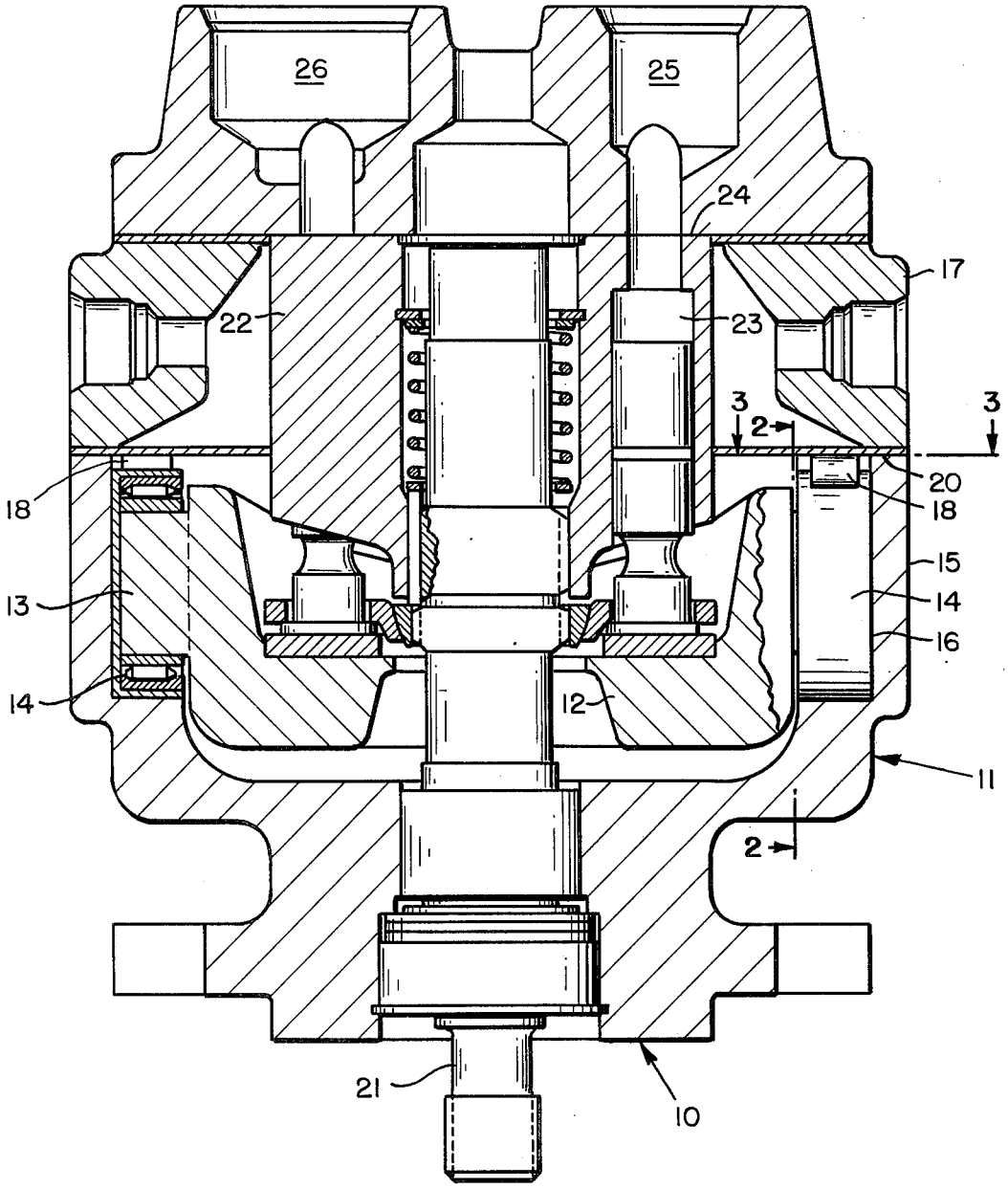
FIG. 1 is an axial sectional view with some parts broken away of a variable displacement cylindrical pump according to a preferred embodiment of the present invention.

With reference to FIG. 1, a variable displacement cylindrical pump 10 is disclosed having a sectional housing 11 and a cam plate 12. The cam plate 12 has oppositely disposed trunnions 13 and trunnion bearings 14 for journalling the trunnions 13. A first generally annular pump housing section 15 has oppositely disposed recesses 16 formed therein in its inner periphery as by cores in a diecasting. These recesses have semi-circular portions 16*a* (see FIG. 2) for axially receiving the cam plate trunnions 13 with their associated bearings 14 assembled thereon. The trunnions 13 and trunnion bearings 14 are secured within the recesses 16 by assembly of a second generally annular pump housing section 17 adjoining the first housing section 15. The trunnions 13 and trunnion bearings 14 are biased toward the semi-circular portion 16*a* by hold down springs 18 (see FIGS. 1, 2 and 3) for preventing vibration of cam plate 12.

With reference to FIGS. 2 and 3, the recesses 16 are illustrated as having a semi-circular lower portion 16*a* which is connected by a slot 16*b* to the upper edge 15*a* of the first housing section 15. Recesses 19 are formed in the sides of the slot 16*b* near the top for locating ends of springs 18 as is shown in FIG. 3.

The springs 18 are preloaded leaf springs having their opposite ends located in opposite recesses 19 and terminating in preloaded coils 18*a*. It will be noted that the ends of the springs 18 are so disposed as to be free of contact with the housing 11, and thus the flexing of the springs 18 cannot wear the housing 11, which is preferably formed of a relatively light metal such as aluminum.

With reference to FIG. 3, the spring 18 bears with substantially uniform pressure upon the upper periphery of bearing 14 to strongly bias the bearing 14 in a unform manner against the semi-circular seat 16*a* in the housing section 15. The coiled ends 18*a* of spring 18 act in a wedge-like manner to restrain the bearing 14 uniformly at its opposite sides in the recess slot 16*b*. The circular ends 18*a* of spring 18 are illustrated as being disposed transversely of the slots 16*b* and being maintained under compression because of three points of contact, namely, in the slots 19, on the outer periphery of the associated roller bearing 14 and against the inner surface of a gasket 20 disposed between the housing sections 15 and 17. The springs 18 are preferably of a width slightly less than the width of the slot 16*b* as is illustrated in FIG. 3. The recesses 19 center the springs 18 within the sides of the slot 16*b*.

Although it will be readily apparent that the invention as described is applicable to a number of different variable delivery pump and motor structures, the preferred embodiment shown in FIG. 1 comprises a drive shaft 21 for rotating a cylinder block 22 having the usual pistons 23 for the communication of fluid through a valve face 24 connected to high and low pressure ports 25 and 26. In the operation of the pump, fluid is retained within the pump housing 11, and there can be no leakage through the casing section 15 of fluid around the trunnions of the cam plate because it is no longer necessary to provide openings adjoining these trunnions through the housing section 15 for the machining of journals and/or assembly of cam plate trunnions 13 and trunnion bearings 14 within the housing section 15.

Figure 5:
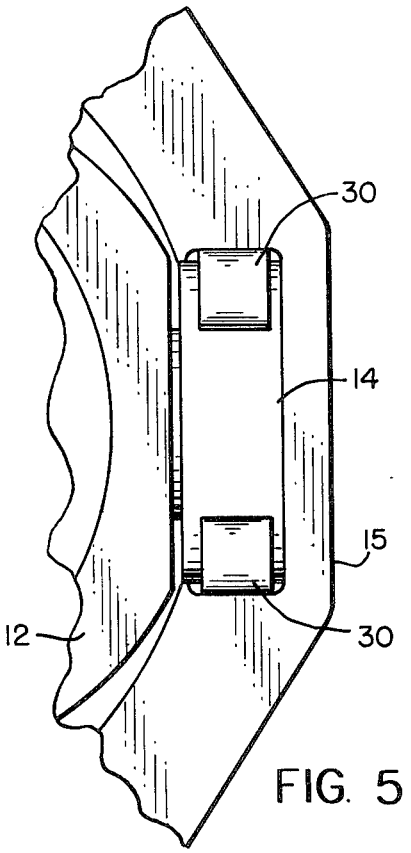
FIG. 5 is a modification of FIG. 3 to further illustrate the use of the modified hold down spring arrangement of FIG. 4.
Figure 4:
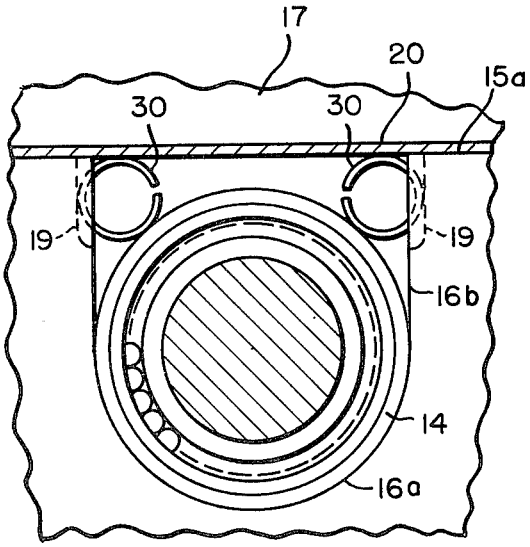
FIG. 4 is a modification of FIG. 2 to illustrate the use of a modified hold down spring arrangement.

With reference to FIGS. 4 and 5, a modified spring hold down arrangement can be provided using independent single turn preloaded springs at opposite sides of the slot 16*b* similarly disposed relative to the ends 18*a* of spring 18 shown in FIGS. 1, 2 and 3, to provide a biasing force comparable to spring 18, the springs 30 must be of heavier construction. They should be accurately formed, with no overlap to provide a sharp edge that could wear the housing 11 in case the springs 30 should become rotated so that their ends would contact a portion of the housing 11.

Figure 6:
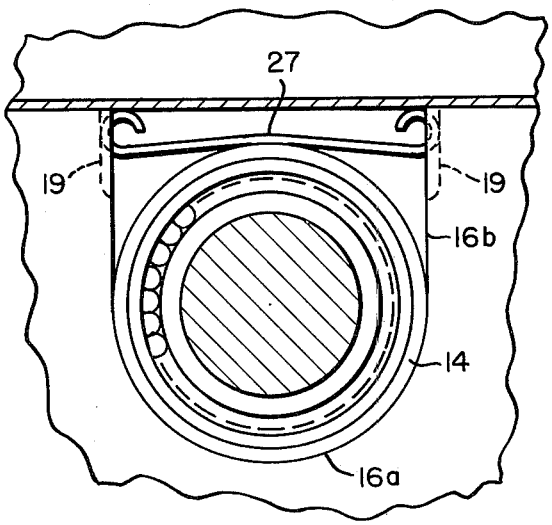
FIG. 6 is another modification of FIG. 2 to illustrate the use of another modified hold down spring arrangement for biasing each of the trunnion bearings.

FIG. 6 shows a modified form of a bearing hold down system comprising a single spring 27 for retaining a trunnion bearing 14 secured within a recess 16. As shown in FIG. 6, this spring is an integral strip of resilient material extending substantially horizontally across the top of bearing 14 and having its ends coiled upwardly to be disposed in opposite recesses 19 in a slot 16*b* in housing section 15. This structure biases the trunnion bearing 14 through a point of contact near its center against the semi-circular base 16*a* of the recess 16 to prevent vibration of the cam plate 12. Spring 27 must be much heavier than spring 18 because all of the biasing force must be applied at a single point of contact.

Figure 7:
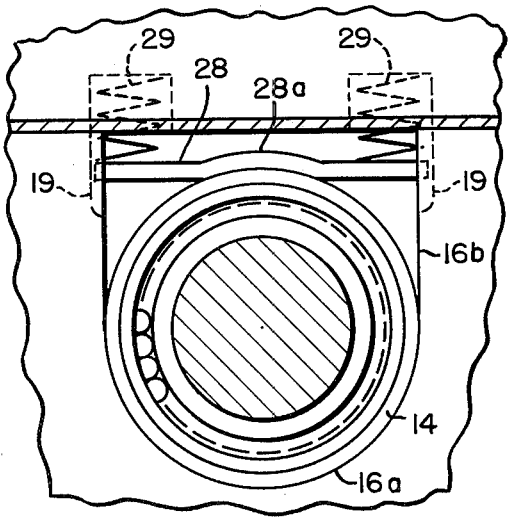
FIG. 7 is another modification of FIG. 2 to illustrate the use of another modified hold down spring arrangement for biasing each of the trunnion bearings.

With reference to FIG. 7, a further modification of a bearing hold down system for the trunnion bearing 14 is illustrated having a substantially rigid retaining plate 28 with a central arcuate portion 28*a* bearing on the top of the trunnion bearing 14 near its center. The plate 28 is biased against the trunnion bearing 14 by vertically disposed compression springs 29 bearing on opposite ends of the plate 28. As in the other forms of the invention that have been described, the springs 29 and the bearing plate 28 are located partly within recesses 19 formed in the side of the slot 16*b*.

Having thus described a variable displacement cylindrical pump having improved journalling of its cam plate as a preferred embodiment of the present invention, it is to be understood that various modifications and alterations may be made to the specific embodiment shown without department from the spirit or scope of the invention.

What is claimed is:

1. A variable displacement cylindrical pump comprising a sectional housing and a cam plate within the housing having trunnions and trunnion bearings wherein improved means for journalling the trunnions in a sectional housing comprises;

a. an integral first generally annular pump housing section having oppositely disposed recesses formed from one end thereof only in its inner periphery and not penetrating the outer periphery of the integral housing section for permitting the cam plate with its trunnions and trunnion bearings assembled thereon to be inserted within the first housing section from said one end with its bearings journalled in the recesses, b. securing means including a second generally annular pump housing section adjoining the first housing section for securing the cam plate trunnions and trunnion bearings within the recesses, and c. resilient means disposed between the second housing and each trunnion bearing for preventing vibration of the cam plate.

2. A variable displacement cylindrical pump according to claim 1 wherein the recesses include slots of a width corresponding to the outside diameter of the bearings extending to one end of the first housing section from semi-circular recess portions for permitting assembly of the cam plate trunnions with the trunnion bearings assembled thereon within the first annular pump housing section.

3. A variable displacement cylindrical pump according to claim 2 wherein recesses are formed in sides of the slots for locating the resilient means.

4. A variable displacement cylindrical pump according to claim 1 wherein the resilient means comprises hold down springs disposed between each of the trunnion bearings and the second pump housing for preventing vibration of the cam plate.

5. A variable displacement cylindrical pump according to claim 4 wherein the resilient means includes spaced coil springs for biasing opposite sides of each of the cam plate trunnion bearings against the semi-circular portion of the associated recess.

6. A variable displacement cylindrical pump according to claim 5 wherein the coil springs have several turns each, are disposed longitudinally relative to each recess and are seated on a substantially rigid strip of material bearing at an intermediate point on an associated trunnion bearing.

7. A variable displacement cylindrical pump according to claim 5 wherein the coil springs are formed by approximately a single turn of flat resilient material of a width slightly less than the depth of the recesses.

8. A variable displacement cylindrical pump according to claim 6 wherein each of the springs is maintained under compression by points of contact with the periphery of one of the bearings, one side of one of the recesses and one end of the second housing section.

9. A variable displacement cylindrical pump according to claim 7 wherein the springs in each recess are integrally connected by a preloaded leaf spring that bears on a substantial portion of the periphery of an associated trunnion bearing.

* * * * *